United States Patent [19]

Petit

[11] Patent Number: 5,025,941

[45] Date of Patent: Jun. 25, 1991

[54] DOME SHAPED CLOSURE CAP

[75] Inventor: Robert Petit, Paris, France

[73] Assignee: L.I.R. France, Chevilly la Rue, France

[21] Appl. No.: 525,347

[22] Filed: May 17, 1990

[51] Int. Cl.[5] ..... B65D 51/18

[52] U.S. Cl. ..... 215/228; 215/227

[58] Field of Search ..... 215/228, 230, 319, 329, 215/227; 220/376, 377, 212, 521

[56] References Cited

U.S. PATENT DOCUMENTS

| | | | |
|---|---|---|---|
| 1,031,867 | 7/1912 | Peebles | 220/288 X |
| 2,168,594 | 4/1930 | Von Till . | |
| 3,002,647 | 10/1961 | Potoff et al. | 220/376 |
| 3,050,212 | 8/1962 | Longo | 220/377 X |
| 3,085,709 | 4/1963 | Klein | 215/228 X |
| 3,628,686 | 12/1969 | Burton . | |
| 3,896,974 | 9/1975 | McIntosh | 215/228 X |
| 4,165,009 | 8/1979 | Murayama . | |
| 4,253,580 | 3/1981 | Doi et al. . | |
| 4,771,902 | 9/1988 | Teng | 215/227 X |

FOREIGN PATENT DOCUMENTS

| | | | |
|---|---|---|---|
| 0285466 | 5/1988 | European Pat. Off. | 215/228 |
| 2551245 | 5/1977 | Fed. Rep. of Germany . | |
| 719330 | 2/1932 | France . | |
| 729291 | 5/1955 | United Kingdom . | |

*Primary Examiner*—Stephen Marcus
*Assistant Examiner*—Vanessa M. Roberts
*Attorney, Agent, or Firm*—Kane Dalsimer Sullivan Kurucz Levy Eisele and Richard

[57] ABSTRACT

The invention relates to a closure cap having a structural arrangement which provides a frictional fitting dome attachment to the base and provides an arrangement in which any shaped dome can be fitted thereon. Moreover, hot stamped discs with decorative designs are placed below transparent domes. This allows a manufacturer to vary the cap configurations.

10 Claims, 2 Drawing Sheets

DOME SHAPED CLOSURE CAP

BACKGROUND OF THE INVENTION

1. Field of the Invention

This invention is related to a closure cap having a structural arrangement which provides a friction fitting dome attachment to the base and provides an arrangement in which any shape dome can be fitted thereon. This provides for an aesthetically appealing product by permitting the closure cap to be formed with various dome configurations. Additionally, when a clear dome is used, a disc with a hot stamped design can be placed under the clear dome as a decorative or advertising element to add to the aesthetic appeal of the cap.

2. Description of the Prior Art

In the advertising and sale of the highest quality perfumes, cosmetics and similar products, it is desireable to use bottles and containers which convey to the consumer the quality of the product contained therein. This may be done in either an understated or a flamboyant manner. Moreover, particularly when a single manufacturer manufactures several related products, the manufacturer may want to distinguish the product line in a general way, while maintaining individual distinctions amongst the variations within the product line. Additionally, the manufacturer may wish to achieve these goals economically without having to provide individual manufacturing facilities for each distinction in packaging in the product line.

An ideal way to achieve this goal is to provide bottles or containers with caps or stoppers which include means to interchange various dome shapes thereupon. Moreover, with the use of clear domes upon the caps, discs with variety of designs can be interchangeably placed underneath the dome.

SUMMARY OF THE INVENTION

This invention includes a closure cap having a structural arrangement which provides a frictional fitting dome attachment to the base and provides an arrangement in which any shaped dome can be fitted thereon. This provides for an aesthetically appealing product by permitting the closure cap to be formed with various dome configurations. Additionally, with the use of a transparent dome piece, decorative discs can be inserted thereunder in order to provide for different visual effects and product differentiation.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENTS

Figure 1:
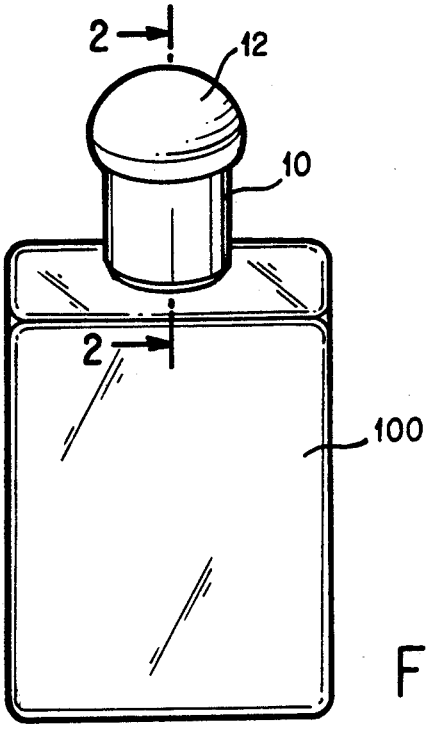
FIG. 1 discloses a front perspective view in elevation of a bottle including the cap of the present invention.
Figure 6:
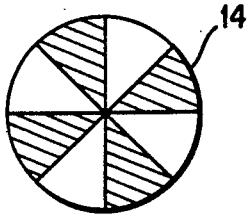
FIG. 6 discloses a front view of a hot stamped disc with an illustrative decorative design thereon.

Referring now to the drawings in detail wherein like numerals indicate like elements throughout the several views, FIG. 1 discloses a front perspective view of perfume or cosmetic bottle 100 with cap 10 thereupon. Friction-fit dome 12 is affixed to the crown of cap 10. Dome 12 not only serves a decorative function, allowing for the manufacturer to produce a variety of caps to allow for product differentiation without excessive manufacturing costs, but also provides a place for the user to grasp the capped bottle firmly. Dome 12 may be opaque, translucent or transparent. In the case of transparent domes, hot stamp disc 14 (see FIGS. 2, 3 and 6) is inserted underneath dome 12 so as to allow for further product differentiation without excessive manufacturing costs.

Figure 2:
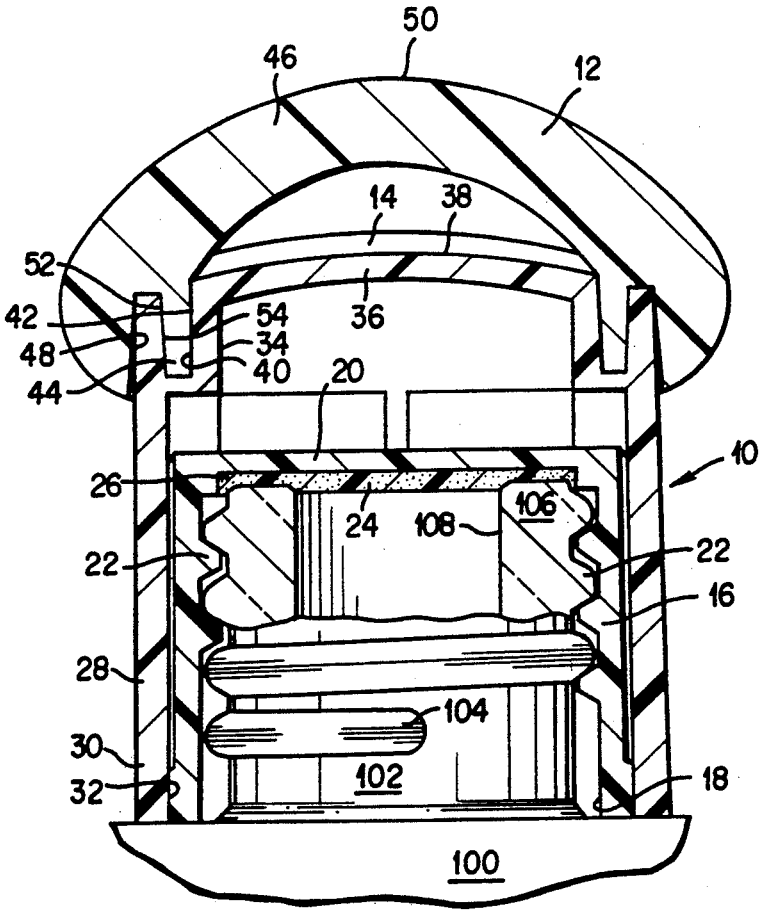
FIG. 2 discloses a cross-sectional view along Plane 2—2 of FIG. 1, partly in elevation, of a first embodiment of the cap of the present invention, adapted to the threads of bottles commonly found in the United States.

FIG. 2 discloses a first embodiment of the cap 10 of the present invention, adapted to the stem 102 with threads 104 thereupon of bottles 100 commonly found in the United States. Similarly, FIG. 3 discloses a second embodiment of the cap 10 of the present invention, adapted to the stem 102 with threads 104 thereupon of bottles 100 commonly found in Europe. Inner sleeve 16 is of a hollow cylindrical shape with an open end 18, a closed end 20 and interior threads 22. Open end 18 engages stem 102 and abuts bottle 100. In FIG. 2, closed end 20 abuts the distal end 106 of stem 102, engaging a water-resistant flexible gasket 24 within recess 26 against opening 108 of distal end 106 of stem 102 while in FIG. 3, plug 27 extends from closed end 20 into opening 29 forming a watertight connection therebetween. Inner sleeve 16 fits concentrically within outer shell 28. Outer shell 28 includes a concentric cylindrical sleeve 30 with an open end 32 to engage stem 102 and abut bottle 100. Sleeve 30 also includes a distal section of reduced diameter 34 to serve as a stop for inner sleeve 16. Distal section of reduced diameter 34 is positioned so as to allow the insertion of a variety of lengths of inner sleeve 16 in order to accommodate a wide variety of lengths of stem 102 and configurations of thread 104. As can be seen from comparing FIGS. 2 and 3, FIG. 2 discloses an inner sleeve 16 to accommodate a shorter stem 102 and threads 104 common to the U.S. while FIG. 3 discloses and inner sleeve 16 to accommodate a longer stem 102 and threads 104 common to Europe. Inner sleeve 16 and outer shell 28 may be attached by a closely machined fit or by glue or a similar bonding agent.

Outer shell 28 includes arch 36 which rises above distal section 34. The upper side 38 of arch 36 provides support for hot stamp disc 14 in the case of a transparent dome. Upwardly facing annular notch 40 is formed outwardly adjacent to arch 36. Upwardly facing annular notch 40 includes inner wall 42 and outer wall 44.

Figure 3:
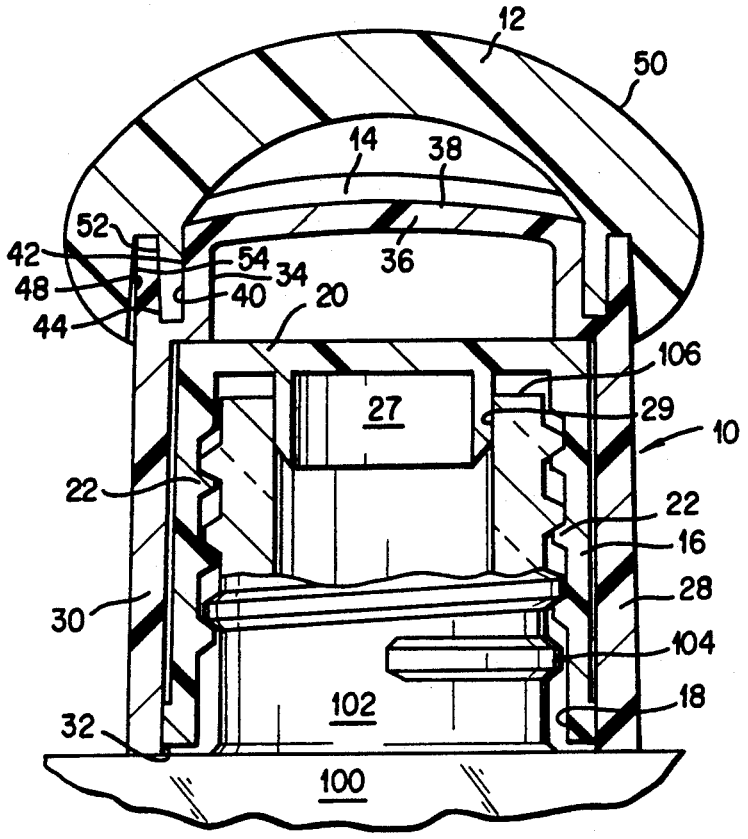
( FIG. 3 discloses a cross-sectional view along plane 2—2 of FIG. 1, partly in elevation, of a second embodiment of the cap of the present invention, adapted to the threads of bottles commonly found in Europe.
Figure 4:
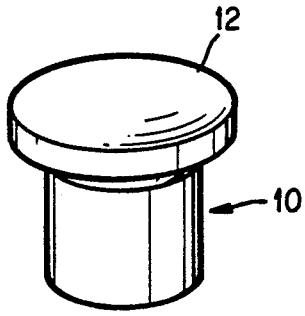
FIGS. 4 and 5 disclose a front perspective view in elevation of alternative dome shapes of the cap of the present invention.
Figure 5:
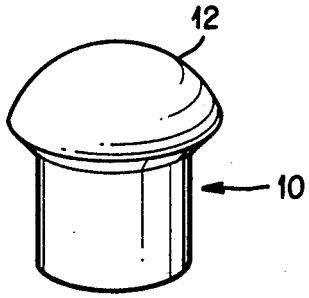

Dome 46 can have various shapes, arcuate or otherwise, including upwardly extending ovoid portion 50 as shown in FIGS. 2 and 3 or any variations thereof as shown in the illustrative examples of FIGS. 4 and 5. The lower portion of dome 46 includes downwardly facing annular notch 48 with inner face 52 and outer face 54. Downwardly facing annular notch 48 is configured to engage outer wall 44 of outer shell 28 while upwardly facing annular notch 40 is configured to engage inner face 52 of dome 46. Outer face 54 can be shaped so as to be integrated into the upwardly extending ovoid portion 50.

In the case of a transparent dome 46, hot stamp disc 14 is placed upon upper side 38 of arch 36.

In order to use this cap 10, the user takes an outer shell 28 and chooses the inner sleeve 16, dome 46, and, optionally, hot stamp disc 14 as is appropriate for bottle 100, stem 102 and the product (not shown) contained within bottle 100. The user then assembles the cap 10 as described herein and screws the cap onto the stem 102 of bottle 100.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A cap for a container including a hollow cylindrical body; a section of reduced diameter within said body; a support member rising above said section of reduced diameter; means for securing said body to the container comprising a threaded inner sleeve concentric within said body and below said section of reduced diameter; a first detent means on an upper end of said body; and an upwardly extending arcuate dome including a second detent means; wherein said first and second detent means engage each other so as to interchangeably secure said upwardly extending arcuate dome to the cap.

2. The cap of claim 1 wherein said threads of said means for securing are internal within said body.

3. The cap of claim 2 wherein said first detent means comprises an upwardly facing annular notch; wherein second detent means comprises a downwardly facing annular notch; and wherein said first and second annular notches adjacently engage one another.

4. The cap of claim 3 wherein an outer diameter of said upwardly facing annular notch is substantially equal to an inner diameter of said downwardly facing annular notch.

5. The cap of claim 4 wherein said upwardly extending arcuate dome is transparent and wherein a decorative disc is inserted between said upwardly extending arcuate dome and said body.

6. The cap of claim 5 wherein said decorative disc is hot stamped.

7. The cap of claim 1 wherein said first detent means comprises an upwardly facing annular notch; wherein second detent means comprises a downwardly facing annular notch; and wherein said first and second annular notches adjacently engage one another.

8. The cap of claim 7 wherein an outer diameter of said upwardly facing annular notch is substantially equal to an inner diameter of said downwardly facing annular notch.

9. The cap of claim 8 wherein said upwardly extending arcuate dome is transparent and wherein a decorative disc is inserted between said upwardly extending arcuate dome and said body.

10. The cap of claim 9 wherein said decorative disc is hot stamped.

* * * * *